US008900104B2

(12) United States Patent
Shozda

(10) Patent No.: US 8,900,104 B2
(45) Date of Patent: Dec. 2, 2014

(54) BULLET-POCKET DUMBBELL EXERCISE APPARATUS

(75) Inventor: Andy Shozda, Schaumburg, IL (US)

(73) Assignee: Barbara Shozda, Schaumburg, IL (US)

( * ) Notice: Subject to any disclaimer, the term of this patent is extended or adjusted under 35 U.S.C. 154(b) by 287 days.

(21) Appl. No.: 13/385,033

(22) Filed: Mar. 1, 2012

(65) Prior Publication Data

US 2013/0231225 A1 Sep. 5, 2013

(51) Int. Cl.
*A63B 21/072* (2006.01)
*A63B 21/075* (2006.01)

(52) U.S. Cl.
USPC ..... 482/108; 482/106

(58) Field of Classification Search
CPC ..... A63B 21/075; A63B 21/00065; A63B 21/0728; A63B 21/0726; A63B 21/072; F16B 21/02
USPC ..... 482/44, 49–50, 92–94, 97–104, 482/106–108; 403/98, 109.2–109.3, 403/164–465, DIG. 14; 285/307, 321
See application file for complete search history.

(56) References Cited

U.S. PATENT DOCUMENTS 3,391,954 A * 7/1968 Callahan ..... 403/372
5,464,379 A * 11/1995 Zarecky ..... 482/108
5,820,290 A * 10/1998 Galindo ..... 403/327
6,439,797 B1 * 8/2002 Campbell ..... 403/321
7,001,310 B1 * 2/2006 Brice ..... 482/107
7,913,590 B2 * 3/2011 Lin ..... 81/121.1
8,608,627 B2 * 12/2013 Ross et al. ..... 482/93
2004/0067826 A1 * 4/2004 Elledge ..... 482/106

FOREIGN PATENT DOCUMENTS

GB 2413288 A * 10/2005 ..... A63B 21/075

* cited by examiner

*Primary Examiner* — Loan H Thanh
*Assistant Examiner* — Joshua Lee
(74) *Attorney, Agent, or Firm* — Lester N. Arnold

(57) ABSTRACT

An improved dumbbell exercise apparatus includes at least a pair of novel bullet-pocket configured weight plate members to be mounted in spaced end-wise relationship on a dumbbell bar, wherein each weight plate member is configured to include at least a pair of cylindrical pocket-like openings extending axially through the thickness dimension of the weight plates, respectively, in parallel and axially offset extension to each other, and at least a singular bullet-weight cylinder of conforming cylindrical dimension to the radius of an aligned singular cylindrical pocket opening in the weight plate, is selectively axially inserted into an aligned cylindrical pocket opening, in order to add or adjust weight to the weight plate, and novel locking means are provided to mount on the weight plate to prevent dislodging of the weight cylinder from the cylindrical opening during use of the dumbbell exercise apparatus.

2 Claims, 6 Drawing Sheets

BULLET-POCKET DUMBBELL EXERCISE APPARATUS

BACKGROUND OF THE INVENTION

1. Field of the Invention

This invention relates to adjustable barbell or dumbbell exercise devices, and more particularly, to a novel end-mounted weight plate assembly to use with such barbell or dumbbell exercise devices, including bullet-pocket cylindrical openings disposed in each of the weight plate assemblies, and bullet-pocket weight cylinders to slide into or out of an aligned cylindrical opening to add or remove weight cylinders for adjusting the weight amount of the associated weight plate assembly. The term "bullet-pocket" is a descriptive term codified by the applicant to refer to the cylindrical opening in the weight plate assembly that receives a "bullet-cylinder" weight cylinder including novel features, and to be inserted into or removed from an aligned and correspondingly diametrical and elongated cylindrical opening that is termed herein as "bullet-pocket cylindrical opening" into which to receive a "bullet-cylinder" or "bullet-pocket" weight cylinder. It is common practice in the pertinent art of such adjustable dumbbell exercise devices to provide a generally elongated cylindrical shaped bar member including a hand grip section along its central elongated dimension to manually lift the weight end-loaded dumbbell assembly. Further, the spaced-apart free-end portions of the bar member are provided to receive radial extending weight plates that are weight adjustable and that are to be secured onto the free-end portions of the bar member for permitting manual lift of the barbell exercise device without dislodging the weight plates during use. The prior art discloses a multiplicity of configurations of weight plates, and parallel mounting or stacking of axially received weight plates on the free-ends of the bar member, and multiple manners of adjusting or securing the parallel mounted weight plates, in addition to simply adding another fixed weight plate to the free-end of the dumbbell.

2. Background of the Invention

Dumbbell exercise devices are the pertinent art of the current invention. The prior art is replete with various configurations of dumbbell handle and elongated bar members to comprise rotatable exercise devices. Stackable and securable parallel side-by-side weight plate assemblies are disclosed in prior art patents, and the manners of stacking and/or securing the weight plates are the object of these inventions. This invention discloses a novel cylindrical shaped weight plate assembly that includes at least a pair of cylindrical pocket-like openings to extend axially through or substantially through the thickness dimension of a thickened radially extending weight plate, the cylindrical openings being radially offset or removed from the central axis of the weight plate assembly and aligned oppositely from each other across the central axis to provide a balanced set of openings, respectively. Each of the cylindrical openings preferably extend through the thickness dimension of the cylindrical weight plate assembly and disposed to extend in parallel offset position with respect to the central axis of the cylindrical weight plate assembly, and are equally offset from the central axis of the weight plate assembly. Each weight plate assembly further includes at least a singular bullet-cylinder shaped weight cylinder of corresponding or matching cylindrical dimension to the length and radius of an aligned singular cylindrical bullet-pocket opening in the weight plate, and the weight cylinder is designed and intended to be axially inserted into or removed from an aligned one of the pair of cylindrical bullet-pocket openings, in order to add or remove (adjust) weight amounts with respect to the weight plate assembly. The weight plate assembly is provided with a circumferential extending radial aperture encircling the central axis of the weight plate which selectively opens into each of the bullet-pocket cylindrical openings. First flexible locking means in the form of a flexible circular band member is positioned for its mounted position in the radial aperture and surrounds the axial dimension of the weight plate, and where the radial aperture has been selectively disposed to open into the bullet-pocket cylindrical openings, the flexible band member is permitted and mounted to angularly intersect and extending to cross an outer diametrical portion of the cylindrical openings for a purpose herein to be set forth.

It is a novel feature of this invention to provide that the bullet-pocket weight cylinder includes along its length dimension and disposed along the diametrical surface thereof, a relatively shallow grove or aperture that extends parallel to the end portions of the weight cylinder, and extends along the cylindrical surface of the weight cylinder only a distance that roughly matches or exceeds the extension of the intersecting section of the flexible band member into the cylindrical opening. The aperture in the diametrical surface of the weight cylinder comprises second locking means to cooperate with the first locking means in the form of the intersecting flexible band member disposed in the cylindrical openings to engage with the intersecting band member by receiving the intersecting section of the band member into its aperture defined by the shoulders of the aperture or groove made or cut into the outer cylindrical surface of the weight cylinder. The first locking means and second locking means cooperate or combine to provide cylinder locking means to lock or secure or hold and restrain against axial movement of the weight cylinder as mounted within the associated bullet-pocket cylindrical opening into which the weight cylinder is insertedly received. The aperture in the surface of the weight cylinder is generally shaped to appear as a radially extending cutout groove of the outer cylindrical surface so that the ends of the aperture re-emerge into the surrounding cylindrical surface to provide displacement cam means for displacing by cam action (rotating movement) the received intersecting section of the flexible band member as a result of rotational movement of the weight cylinder either clockwise or counter-clockwise rotation thereof. The intersecting section of the flexible band member is rotatingly moved out of the weight cylinder aperture to engage the outer cylindrical surface of the cylinder with the rotation of the weight cylinder and the weight cylinder is then free of the interfering engagement by the intersecting section of the flexible band member, to allow the cylinder to be removed from its associated bullet-pocket cylinder.

It is another novel feature of the current invention to provide along the inserted free-end portion of the weight cylinder, an edge groove (groove cut into the insertable cylindrical edge of the free-end portion of the weight cylinder) defining an angularly extending shoulder portion cut or formed in the diametrical surface of the free-end portion of the weight cylinder. In the same manner as the aperture in the weight cylinder has its opposite end portions to re-emerge into the surrounding surface of the cylindrical shape of the weight cylinder, the opposite end portions of the angularly extending shoulder portion also re-emerge into the surrounding adjacent surface of the cylindrical weight cylinder. In accordance with the novel feature of providing the shoulder portion, as the weight cylinder is being inserted into the aligned cylindrical opening in the weight plate, the shoulder portion is caused to come into contact with the aforementioned intersecting section of the flexible band member which has been disposed to lie in an angular crossing or intersection within the cylindrical opening at the point where the cylindrical opening and the circumferential radially extending aperture in the weight plate communicate or open into each other.

It is at once obvious from the position of the elements being described that the angularly intersecting band member disposed to lie across the cylindrical opening will interfere with the insertion of the weight cylinder. However, with the weight cylinder rotated to an aligned position wherein the edge grove (shoulder portion) of the weight cylinder will intersect, abut or engage the crossing or intersecting section of the retractable band member, whereby the intersecting section of the band member is disposed to lie parallel to and be engaged by the shoulder portion thereof with rotational movement of the weight cylinder, the rotation of the weight cylinder in either clockwise or counter-clockwise movement will displace by camming action the intersecting section of the flexible band member by pushing or forcing the crossing section back into its receiving radial aperture of the weight cylinder. Thus, the weight cylinder shall be freed from the interference of the flexible band member to move on past this point of interference along the length dimension of the cylindrical opening, whereby the weight cylinder may move axially into fully inserted position with respect to the associated cylindrical opening.

It is noted that this edge groove is useful during insertion of the weight cylinder and is immaterial during removal of the weight cylinder. It can be said that the action of rotation of the weight cylinder during insertion results in initially removing by cam action the interfering intersecting section of the flexible band member and permits further insertion of the weight cylinder into the aligned and selected cylindrical opening in the weight plate, and thereafter, results in achieving alignment of the radial aperture of the weight cylinder with the intersection section of the flexible band member which has been removed from the cylindrical opening by cam action and is under tension to re-enter the radial aperture of the weight cylinder when aligned therewith. Further, in order to achieve removal of the weight cylinder from its receiving cylindrical opening, in which it is restrained or secured or locked by joint action of the length-wise and rotational alignment between the radial aperture on the weight cylinder and the intersecting section of the flexible band member, the rotational movement either clockwise or counter-clockwise of the weight cylinder will result in the forced band section removal, by cam action caused by the configuration of the radial aperture, of the intersecting section of the flexible band member from the radial aperture of the weight cylinder, to disengage the weight cylinder, and permit free removal of the weight cylinder from the aligned and receiving associated one of the multiple cylindrical openings in the weight plate. The combination of the weight plate assembly provided with predetermined multiplicity of bullet-pocket cylindrical openings therein, combined with aligned and inserted associated bullet-pocket weight cylinders comprise a novel weight plate assembly, to provide an improved bullet-pocket dumbbell exercise apparatus in accordance with the novel features of the current invention.

DESCRIPTION OF THE PRIOR ART

The art of manual exercise known as weight lifting includes the common practice of manual lifting of barbells or dumbbell devices particularly designed to achieve weight exercising of body muscle groups of the user, and such state of the art dumbbells are comprised of a generally elongated cylindrical shaped bar member including a rotatable central sleeve or hand grip section mounted to be disposed along the central elongated dimension of the bar member, to provide means of manually lifting and rotation of the weight loaded dumbbell assembly. It is common practice to mount desired weighted plates opposite to each end of the bar member, on the free-end portions of the bar member, and to provide means to secure or lock the selected weight plates with respect to the bar member, and sometimes to each other, in order to provide axially secure rotatable weight plates, and equal balance of the dumbbell assembly for safe exercise purposes. Collar members or sleeve members are known to be inserted onto the free-end portions of the bar member to clamp onto the bar member to axially secure the weight plates to the fee-end portions of the bar members.

This invention is particular directed to providing an improved dumbbell apparatus including in combination novel weight plate assemblies, each of which is weight adjustable by means of providing bullet-pocket cylindrical openings in the weight plate as mounted to each free-end portion of an elongated bar member, and by means of providing bullet-pocket weight cylinders of corresponding radial dimension to the radius of the bullet-pocket cylindrical openings to be inserted into or removed from an associated and aligned cylindrical opening in order to adjust the amount of weight, pounds or metric weight, of the end-mounted weight plate assembly. At least a pair of cylindrical pocket openings are provided in each end-mounted weight plate assembly, extending axially through or substantially through, the thickness dimension of the weight plates, respectively, in parallel and axially offset extension to the central axis of the weight plate, and includes at least a singular bullet-pocket weight cylinder of conforming cylindrical dimension to the radius of an aligned singular cylindrical pocket opening in the weight plate, to be axially inserted into or removed from the associated and aligned one of the pair of cylindrical pocket openings, in order to add or adjust weight to the weight plate assembly. The invention includes novel locking means of securing the bullet-pocket weight cylinder within the receiving bullet-pocket cylindrical opening, in an improved manner using cylindrical or circular rubber-like flexible band means in the form of a continuous band member, to be mounted on and encircling the circumference of the weight plate assembly, which band member is preferably mountedly received in a circumferentially shaped aperture provided along the thickness dimension of the weight plate, and which aperture of the weight plate is designed to selectively open into and communicate with the cylindrical opening in the weight plate, to permit an intersecting section of the flexible band member to be angularly received into the cylindrical opening for a selected length dimension of the cylindrical opening. The insertable bullet-pocket weight cylinder is complementarily provided with a shallow groove or indentation section in the surface thereof, which when aligned with the communicating and intersecting section of the flexible band member will receive the flexible band section into the aligned groove, thereby to provide locking means to prevent the ease of axial movement of the bullet-pocket weight cylinder with respect to the receiving cylindrical opening, and thereby to secure against dislodging of the weight cylinder during the manual use of the novel dumbbell assembly. Other novel features of this invention shall become readily apparent and obvious during the reading of the detailed specification of this invention.

Pertinent prior art references and their differences from this invention, as have been read and considered by the application of the present invention are as follows, to wit: U.S. Pat. No. 7,621,855 B1 ('855) dated Nov. 24, 2009, presents as its novel feature weight selectors which are movable into and out of engagement with different combinations of end-mounted weight plates to secure a desired amount of mass or weight to the exercise device. The weight selectors are routed through the hand grip portion of the handle member, and are accessible through upwardly opening slots in the weight plates. This prior invention identified as '855 is at once distinguishable from the improved weight plate assembly of the current invention in that adjustable weights of the current invention are attained with insertion or removable of separate bullet-pocket weight cylinders with respect to receiving bullet-pocket cylindrical openings in the associated weight plate assembly.

U.S. Pat. No. 7,811,213 B2 ('213) dated Oct. 12, 2010, discloses slotted weight members and a particular manner of engaging or disengaging each slotted weight member by the use of a sliding member attached to move along the handle. This prior invention identified as '213 is at once distinguishable from the improved bullet-pocket weight plate assembly of the current invention without detailed explanation.

U.S. Pat. No. 7,862,487 B2 ('487) dated Jan. 4, 2011, discloses a manner of selecting the number of mounted weight plates on a barbell weight assembly by use of selection of movable rods housed in an annular handle assembly, to control the number of and amount of weight disposed on each end of the handle. This prior invention identified as '487 is at once distinguishable from the improved bullet-pocket weight plate assembly of the current invention without detailed explanation.

U.S. Pat. No. 7,927,264 B2 ('264) dated Apr. 19, 2011, discloses a spring loaded exercise device that requires user-induced movement during exercising use, and is at once distinguishable from the improved bullet-pocket weight plate assembly of the current invention without detailed explanation. Other U.S. Patents that were considered in a diligent search of the prior art by the applicant are as follows, that is, U.S. Pat. No. 7,789,813 B2 dated Sep. 7, 2010; U.S. Pat. No. 7,172,536 B2 dated Feb. 6, 2007; U.S. Pat. No. 614,982 B2 dated Nov. 10, 2009; U.S. Pat. No. 7,794,373 B2 dated Sep. 14, 2010; U.S. Pat. No. 7,762,933 B1 dated Jul. 27, 2010 (Kettle shaped Dumbbell); U.S. Pat. No. 7,771,330 B2 dated Aug. 10, 2010; U.S. Pat. No. 7,090,625 B2 dated Aug. 15, 2006; U.S. Pat. No. 7,137,931 B2 dated Nov. 21, 2006; U.S. Pat. No. 7,223,214 B2 dated May 29, 2007; U.S. Pat. No. 7,285,078 B1 dated Oct. 23, 2007; U.S. Pat. No. 7,387,596 B2 dated Jun. 17, 2008; U.S. Pat. No. 7,491,155 B2 dated Feb. 17, 2009; U.S. Pat. No. 7,497,814 B1 dated Mar. 3, 2009; U.S. Pat. No. 7,520,845 B2 dated Apr. 21, 2009; U.S. Pat. No. 7,527,582 B2 dated May 5, 2009; U.S. Pat. No. 7,549,952 B2 dated Jun. 23, 2009; U.S. Pat. No. 7,588,519 B2 dated Sep. 15, 2009; U.S. Pat. No. 7,588,520 B2 dated Sep. 15, 2009; U.S. Pat. No. 7,604,578 B2 dated Oct. 20, 2009; U.S. Pat. No. 7,785,239 B2 dated Aug. 31, 2010; U.S. Pat. No. 7,775,948 B2 dated Aug. 17, 2010; U.S. Pat. No. 7,678,031 B2 dated Mar. 16, 2010; and U.S. Pat. No. 7,887,469 B1 dated Feb. 15, 2011. None to these prior references of weight adjustable dumbbell exercise devices disclosed bullet-pocket weight cylinders or devices to be inserted into or removed from receiving openings in the end-mounted weight plate assemblies.

SUMMARY OF THE INVENTION

The novel bullet-pocket dumbbell exercise apparatus of the current invention presents a quick and tool-free means of adding weight to the end-mounted novel weight plate assembly on each end of the carrier bar member of a dumbbell hand set, without having to change or remove the weight plate assembly. In accordance with the novel features of this invention, the weight plate assembly is provided with so-called pocket means in the form of at least a pair of radially offset bullet-pocket cylindrical openings spaced apart equally from the central axis of the weight plate assembly and extending in the preferred embodiment entirely through the thickness dimension of the weight plate member, and provided with so-called insert means in the form of at least a pair of bullet-pocket weight cylinders or cylindrical shaped weight members are provided to align with and be inserted into or removed from the associated and aligned and receiving bullet-pocket cylindrical openings in the weight plate assembly. Locking means is provided to lock or secure the insert means into the pocket means to prevent dislodging the insert means during manual lifting and/or exercise use of the novel dumbbell apparatus. The novel weight plate assembly is provided to be mounted on the opposite free-end portion of the bar member of the dumbbell hand set, in a conventional manner for providing equal balance of end-mounted weight plates on the dumbbell bar member, with rotatable hand grip means provided situated centrally between the spaced-apart end-mounted weight plate assemblies. It is further a novel feature of the current invention to provide novel locking means comprising in combination flexible band means to be mounted on the weight plate, and radial groove means provided for the insert means, combining to permit the selected insertion of a portion of the band means into the radial groove means when aligned, to lock or restrain the insert means from being dislodged from the pocket means during manual use of the novel dumbbell apparatus. The flexible band means is provided by a continuous ring-like flexible band member mounted to encircle the circumferential dimension of the weight plate assembly for being insertedly received in a circumferentially extending groove or aperture means in the form of a circumferential aperture provided in and encircling the weight plate assembly along a selected length dimension thereof, and is provided or formed to selectively open into and provide communication with or into the receiving bullet-pocket cylindrical openings, along a predetermined angular section of the inner circumference wall forming the bullet-pocket cylindrical openings in the weight plate assembly. The encircling flexible band member is thereby positioned to intersect into or angularly cross an outer diametrical section of the cylindrical opening at a selected location along its length dimension defining a so-called intersecting section of the band member. To open the locking means, the bullet-pocket weight cylinder is further provided with end groove means in the form of a circumferential extending relatively shallow surface groove or aperture, disposed to extend in the radial surface of the cylindrical shaped weight cylinder, in a direction parallel with the plane of its end portion, and to become rotationally aligned, during rotational movement of the weight cylinder, with the intersecting section of the flexible band member encroaching into the cylindrical opening, and with designed rotational cam action in the form of cam means, to rotate against the tension of the band member to remove the band member by means of the configuration of the end groove means from crossing into the cylindrical opening, to thus remove the band member that is designed to lock the bullet-pocket weight cylinder within the receiving bullet-pocket cylindrical opening of the weight plate assembly.

In providing opening of the locking means, the bullet-pocket weight cylinder is inserted so as to engage the interfering positioned flexible band section and readily be twisted or rotated by application of the user's fingers, without the necessity of use of a tool, for achieving desired rotation of the weight cylinder, to rotate and move by first cam means, the interfering and intersecting section of the flexible band member out of the cylindrical opening so as to be retrieved back into its mounted aperture, through the provision of providing end groove means defining shoulder means disposed along the radial edge of the free-end insertable portion of the weight cylinder, so as to engage the angular extending section of the flexible band member with and positioned along the shoulder means, thereby to move the intersecting section thereof by so-called first cam means provided by engagement of the intersecting section of the band means with the defined shoulder portion of the end groove means formed in the inserted edge portion of the weight cylinder, to engage and displace or move the flexible band member by first cam means comprising the rotating movement of the weight cylinder while engaging the band member with the shoulder means in the form of the shoulder portion defined by the end groove means, to cause by rotational cam action, the flexible band member to retract against its first innermost position back into its circumferential groove (aperture means) into which the band member is mountedly held, providing tension to be increased on and stored by the band member to provide means to restore the band member when released from restraint, to be restored to its first innermost position within the cylindrical opening. Further, continued insertion of the weight cylinder into the aligned cylindrical opening, and providing proper rotation of the weight cylinder, will cause or result in the alignment of aperture or groove means in the form of the radial surface aperture in the surface of the weight cylinder with or respect to the retracted intersecting flexible band member through means of the stored tension of the retracted band member, to move into or enter the cylindrical opening when aligned and providing the radial surface aperture for entry. Proper alignment as described will cause the intersecting section of the flexible band member to snap or move into the aligned surface groove in the weight cylinder when the weight cylinder is more fully inserted into the receiving cylindrical opening, and the proper rotation of the weight cylinder is provided. The encroaching angularly intersecting section of the band member when received into the surface groove means comprises first locking means in the same manner as would a protruding key plunger for a lock, and the aligned receiving radial groove in the cylindrical surface of the bullet-pocket weight cylinder comprises second locking means on the weight cylinder to receive the insertion of the band member as in locking mechanisms, and the engagement provided therebetween, that is, engagement between the first and second locking means comprises the so-called locking means required to lock or secure or hold the bullet-pocket weight cylinder firmly in the associated selected receiving bullet-pocket cylindrical opening in the weight plate assembly, to provide securement thereof against axial movement during manual use of the novel dumbbell exercise apparatus.

The novel weight plate assembly is provided with a central opening along its central axis through which to receive the insertable free-end of the bar member of the dumbbell set, that is, a weight plate assembly is inserted onto the free-end portion of the bar member by receiving the free-end portion through its central opening along its central axis. A weight plate assembly is thus mounted on both or opposite ends of the oppositely disposed free-end portions of the carrier bar member, and each weight plate assembly is secured in axial position along the bar member by use of end-cap means, in the form of an end-cap threaded bolt member that desirably threads into female receiving threaded means or aperture provided in the immediate outer end of the bar member. Other equally suitable configurations of end-cap means of securing the weight plates to the associated bar member can be used or applied without deviation from the novel features of the present invention. Further, to accommodate rotation of the weight plate assembly with respect to the bar member, the weight plate assembly is provided with ring-like shaped ball bearing means, in the form of a set of ball bearings to fit betweens the end cap bolt member and the weight plate assembly to achieve rotation of the weight plate assembly with respect to the fixed end cap bolt member as the weight plate assembly is made rotational with respect to twisting movements of the bar member along its extended longitudinal axis. In order to maximize the weight changing capacity of the novel weight plate assemblies, each weight plate assembly is provided with at least two pairs of radially aligned and axially offset bullet-pocket cylindrical openings in the thickness dimension thereof, providing the maximum capacity of four bullet-pocket weight cylinders to be inserted into or removed from the aligned ones of the bullet-pocket cylindrical openings. The addition of or removal of bullet-pocket weight cylinders provides a novel and convenient method or capacity to add or remove weight amounts from the weight plate assembly, without having to remove the weight plate assembly itself. The bar member can be provided with sufficiently elongated length dimension to permit or accommodate the mounting of a pair of weight plate assemblies on each end of the bar member for increased weight capacity, with the inner weight plate assembly presenting its bullet-pocket cylindrical openings on its innermost radial surface and the outer weight plate assembly presenting its bullet-proof cylindrical openings on the outermost radial surface thereof for adding and removing bullet-proof weight cylinders. In the preferred embodiment of this invention, the drawing shows and the description of the preferred embodiment discloses a single novel weight plate assembly on each opposite free-end portion of a carrier bar member comprising standard configuration of a dumbbell exercise apparatus.

It is an object of the present invention to provide a novel end-mounted weight plate assembly containing radially aligned and axially offset, meaning radially outwardly offset from its central axis, one or more bullet-pocket cylindrical openings extending through the thickness dimension of the circumferential-shaped weight plate assembly. It is another object to provide one or more bullet-pocket weight cylinders of radial dimension to be received into or removed from an aligned one of the bullet-pocket cylindrical openings to add or remove a predetermined weight amount to or from the weight plate assembly. It is still another object to provide circular ring-like locking band means in the form of rubber-like flexible band member to continuously encircle the circumference of the weight plate assembly along its axial length dimension, and to provide circumferential aperture means in the form of at least one circumferential aperture in and positioned along the thickness dimension of the weight plate assembly conveniently disposed along its axial length (thickness) dimension, for purpose of mounting or receiving therein the flexible band member for purposes herein disclosed. It is still a further object of the invention to provide that the circumferential aperture of the weight plate assembly opens into or communicates with each of the bullet-pocket cylindrical openings at a predetermined opening formed wherein the aperture means opens into the cylindrical openings of the weight plate, defining or providing facility for the band member that is held in the aperture means to enter into the exposed cylindrical opening, at a selected radial position along the inner cylindrical wall thereof that forms or defines the cylindrical opening. It is a further object of the present invention to provide that the flexible band member when inserted into the circumferential aperture of the weight plate assembly will intersect or cross into the cylindrical opening in the weight plate, and the extent of the insertion thereof is defined by the extent of the aperture means being permitted to open into the associated cylindrical opening. It is still another object to provide the circumferential aperture on the circumferential surface of the weight cylinder at a position along its length dimension to align with the communicating opening of the circumferential aperture of the weight plate assembly when the weight cylinder is fully inserted. It is another and further object that the inserted flexible band as is inserted into the associated cylindrical opening of the weight plate, will be engaged and moved by first cam means to retract from insertion into the cylindrical opening as the weight cylinder is inserted into the cylindrical opening, the inserted band member being retracted into the aperture in which it is mounted on the weight plate, and retracted in order to permit the further insertion of the bullet-pocket weight cylinder into the aligned receiving cylindrical opening. It is another and further object to provide increased tension on the band member by reason of the rubber-like flexible nature of the band member so that the band member is stored with tension that will automatically cause the band member to snap back into or enter the cylindrical surface opening disposed along the outer radial surface of the weight cylinder at the point where the weight cylinder is fully inserted and the cylindrical surface opening on the weight cylinder is rotatingly aligned with the inserted section of the flexible bank member. It is another object to provide that the interfering section of the band member as is inserted into the cylindrical opening of the weight plate assembly comprises first locking means provided to engage the weight cylinder to lock or secure or hold the weight cylinder from axial movement with respect to its receiving cylindrical opening. It is a further object to provide second locking means in the form of correspondingly aligned groove means in the form of radially extending relatively shallow groove or aperture in and along the circumferential surface of the weight cylinder of a depth and angle to become aligned with and receive the flexible band section that intersects into or with the cylindrical opening, when the weight cylinder is aligned and inserted into the cylindrical opening of the weight plate assembly to comprise second locking means to engage with the flexible band member to lock or secure or hold the weight cylinder from axial movement with respect to its receiving cylindrical opening. It is an object to provide that the interaction between the first locking means and the second locking means comprises locking means for the weight cylinder to be restrained against axial movement with respect to its insertion into the associated cylindrical opening of the weight plate. It is still another object to provide first cam means in the form of end groove means made in and along the radial edge of the inserted end section of the weight cylinder, that is, on its free-end portion to be inserted into the cylindrical opening, whereby when the end groove means engages the angularly intersecting band member, and the weight cylinder is then rotated within the cylindrical opening the rotation provides first cam means to rotate the band member from its intersecting position back into the aperture means in which it is mounted, storing tension in the band member, and removing the band member from an interfering position within the cylindrical opening, to permit the free passage of the weight cylinder end portion pass the position of the intersecting band member. First cam means is provided by the rotation of the weight cylinder upon insertion into the cylindrical opening so as to engage the band member by the end groove means, and rotation of the weight cylinder by turning clockwise or counter-clockwise (looking at the end of the weight cylinder), will cause forced movement by camming action of the inserted section of the flexible band member from its intersection into the cylindrical opening, to permit the weight cylinder to become free of the intersecting section of the band member, to further enable continued insertion thereof into the associated cylindrical opening. Another object is to provide second cam means during the act of removing the weight cylinder from the aligned cylindrical opening, as by means of convenient hand-grip twisting or turning of the weight cylinder either clockwise or counter-clock wise, whereby with rotation of the weight cylinder, designed rotational cam action will free the inserted section of the flexible band member from the receiving aperture in the weight cylinder to permit the weight cylinder to be removed from the cylindrical opening in the weight plate assembly.

Other objects and features and advantages of the present invention will become readily apparent from the review and consideration of the disclosure as contained in and described in the following specifications and drawings, and all such other or obvious objects and uses and applications are intended to be covered in the scope and intent of the detailed description of the present invention.

THE DRAWINGS

Similar reference characters shall denote corresponding parts, features or elements of the present invention consistently throughout the attached drawings.

DETAILED DESCRIPTION OF THE PREFERRED EMBODIMENT

Figure 1:
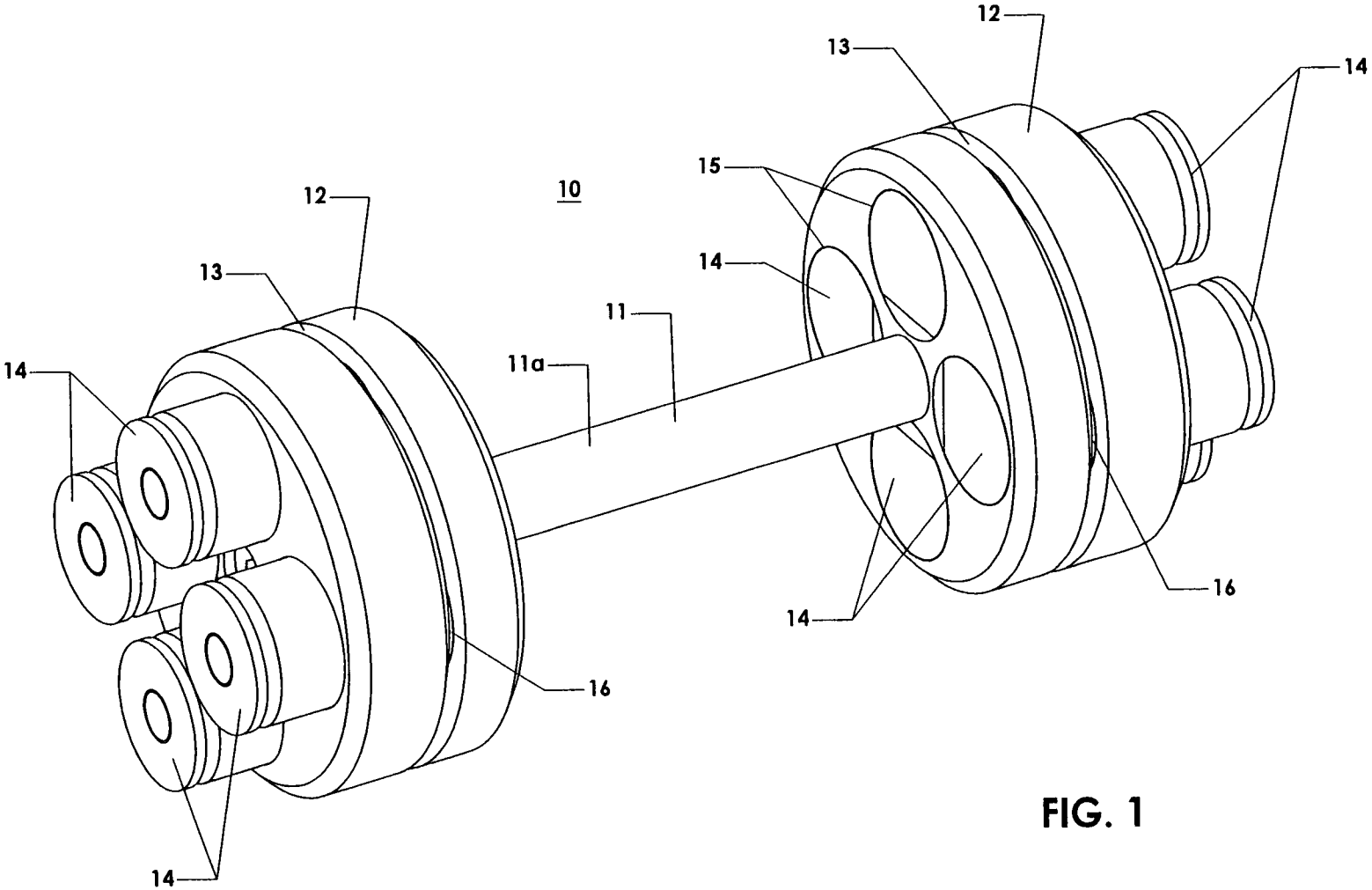
FIG. 1 is an elevated perspective view of the fully assembled improved bullet-pocket dumbbell apparatus of the present invention.
Figure 2:
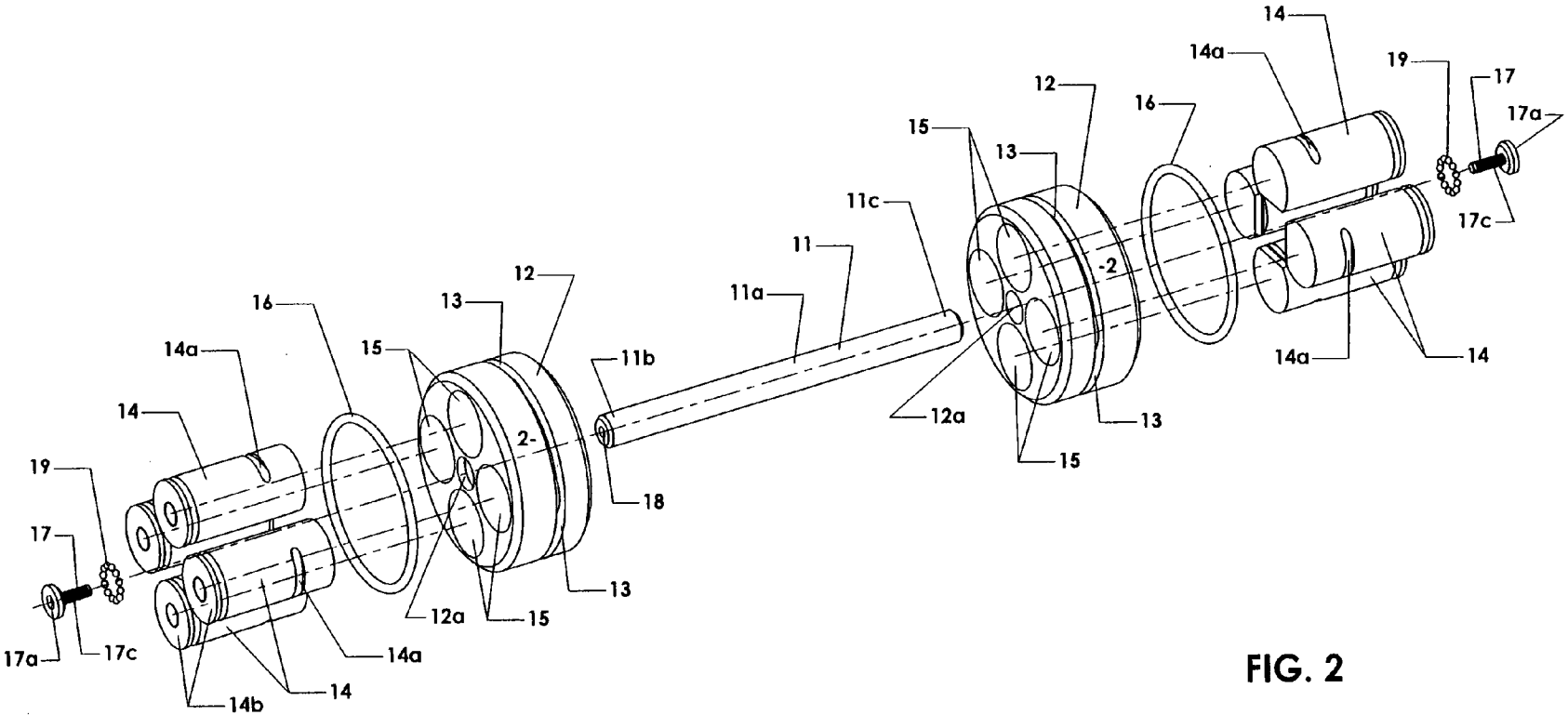
FIG. 2 is an exploded elevated perspective view of the bullet-pocket dumbbell apparatus of FIG. 1 showing removal of insertable parts in alignment to be inserted.

There is shown in FIG. 1 of the drawings at 10 the novel bullet-pocket dumbbell exercise apparatus of the present invention, including an elongated bar member 11 having a central portion 11*a* (around which a rotatable collar or sleeve could be provided but not shown in the drawing) serving as handle grip means along the centrally disposed section of the bar member 11 for the convenience of the user of the dumbbell apparatus 10 to lift and manipulate the dumbbell apparatus 10 during weight lifting exercise routines. The bar member 11 includes free-end portions 11*b* and 11*c* as best shown in FIG. 2, forming the opposite end portions thereof. A weight plate assembly 12 as shown in FIG. 1 and FIG. 2, is designed or intended to be mounted to each of the free-end portions 11*b* and 11*c* of the bar member 11, to comprise the standard dual-end weight mounting of conventional dumbbell or barbell exercise apparatus, but in accordance with the current invention, now presenting the novel features of the present invention. Insertable cylindrical weights comprising so-called insert means are provided in the novel configuration of bullet-pocket cylindrical weight members 14 as are shown in FIG. 1 and FIG. 2, to be inserted into and protruding from the weight plates 12 on the free-end surfaces of the weight plates 12. The weight cylinders 14 are provided to protrude a sufficient amount or length outwardly of the free-end surface of the weight plate 12 to permit ease of grip by the user's fingers to permit rotational movement of the weight cylinders 14 with respect to the weight plate 12 in which the weight cylinders 14 are mounted. The degree of protruding of the weight cylinders 14 is not critical to the novelty of this invention so long as sufficient grip can be obtained, and to this end the free-end portions of each of the weight cylinders 14 are provided with a convenience end groove (not numbered but clearly shown in the drawing) to facilitate gripping of the protruding end portion of the weight cylinder 14. Each weight plate assembly 12 is provided at a selected generally mid-portion along the outer surface thereof, with aperture means in the form of a circumferential extending aperture or groove 13 disposed along the length dimension as shown in FIG. 1. Each weight plate assembly 12 is provided with so-called pocket means in the form of at least a pair of cylindrical openings 15 (two pair of openings 15 being shown in FIG. 1 and FIG. 2 as the preferred embodiment) diametrically offset and extending parallel substantially through or entirely through (preferred embodiment) the thickness dimension of the weight plate assembly 12. In accordance with a feature of the invention, novel locking means is provided to achieve the stability of the insert means within the pocket means when inserted to achieve the unique locking feature of the invention. It is obvious to require that the insert means should be locked within the pocket means during manual lifting of the user of the novel dumbbell apparatus. To provide locking means, it is first provided that each circumferential aperture 13 has a depth of cut or extension into the circumference of the weight plate 12, sufficient that the aperture 13 will enter or open into and communicate with each of the cylindrical openings 15 of the weight plate assembly 12, as is more clearly shown in subsequent figures of the drawing showing exploded and perspective isolated views. Circumferentially continuous ring-like flexible band means in the form of a flexible band member 16 is then mounted into the circumferential groove 13 in the weight plate 12, but is more clearly shown in FIG. 2 and subsequent exploded isolated perspective views of the drawing. The flexible band member 16 has an innermost mounted position within the receiving aperture or groove 13 to cause the band member 16 to intersect or cross into the cylindrical opening 15 into which the groove 13 is cut and communicates. The intersecting band member 16 will provide first locking means for the restraint of the weight cylinder 14. The dumbbell apparatus 10 of FIG. 1 is the fully assembled and ready to use improved bullet-pocket dumbbell exercise apparatus 10 of the present invention.

Figure 3:
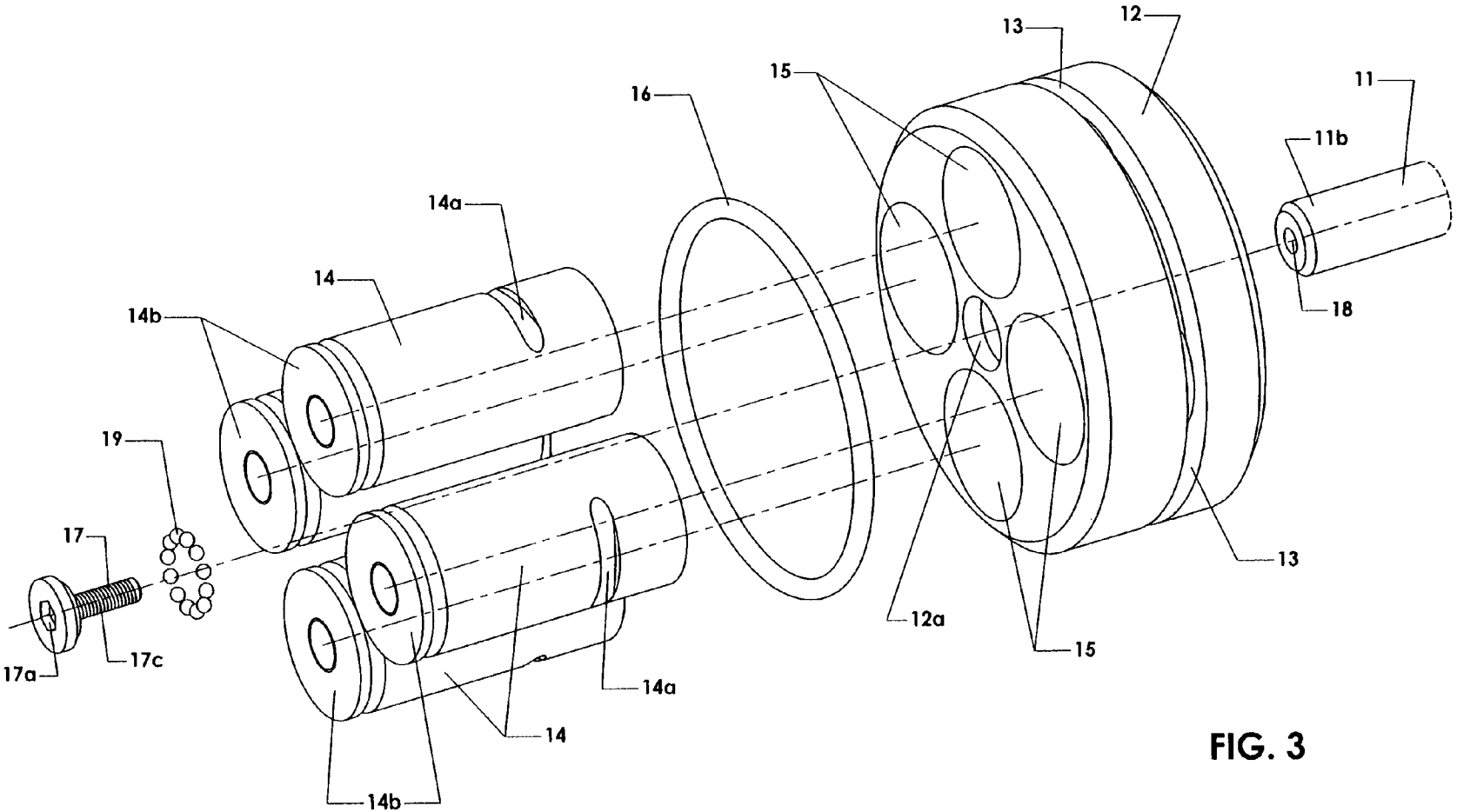
FIG. 3 is an exploded isolated end view of one end of the dumbbell apparatus of FIG. 2.

FIG. 2 is an exploded elevated perspective view of the bullet-pocket dumbbell apparatus 10 of FIG. 1, showing the insertable parts thereof as numbered and shown in FIG. 1, arranged in their respective alignment and removal from assembly, and remaining in alignment to be inserted with respect to each other. FIG. 3 is a larger isolated exploded perspective view of one of the weight plate assemblies 12 to be mounted on a free-end portion 11*b* of the bar member 11, similar to FIG. 4, and the numbered parts thereof will be set forth in the drawing in order to achieve a more enabling disclosure of the present invention. Now by reference to FIG. 2-4 of the drawings, there is shown a pair of weight plate assemblies 12 (FIG. 2) and an isolated view of a left-end (direction shown in FIG. 2) weight plate assembly 12 (FIG. 3-4) that are configured and aligned to be inserted and assembled together as follows, to wit: The weight plate assembly 12 is a thickened circumferential integral plate 12 having a thickened dimension along the bar member 11, and including a central longitudinal axis extending along line 2-2 of FIG. 2 which is common with the bar member 11, and around which axis 2-2 to provide its rotation. The weight plate assembly 12 is provided with a central opening 12*a* (FIG. 2) along the central axis 2-2 thereof into which to receive the aligned one of the free-end portions 11*b* and/or 11*c* of the bar member 11. The weight plate assembly 12 is held or secured to the end portion 11*b* or 11*c* of the bar member 11 by means of providing end-cap locking means in the form of an end-cap threaded bolt 17 having a head portion 17*a*, a hexagonal recessed central opening 17*b* into which to insert a conforming shaped tool for obtaining rotation thereof, and an elongated threaded stem portion 17*c*, with the portion 17*c* to be received into a female-threaded opening or aperture 18 provided in the free-end portion 11*b* or 11*c* of the bar member 11, as best shown in the FIG. 3. In a conventional manner of providing rotation of the weight plate assembly 12, ball bearing means in the form of a ball bearing set 19 is provided to encircle the cap end portion 17*a* of the bolt 17 to provide that the weight plate assembly 12 will readily rotate around or with respect to the bar member 11 of the dumbbell device 10. The weight plate assembly 12 is provided with pocket means in the form of at least a pair of axially offset and oppositely aligned cylindrical openings 15 to extend substantially or entirely through (in the preferred embodiment) the thickness dimension of the weight plate 12, and further is provided with insert means in the form of at least a pair of the weight cylinders 14, in which to insert the weight cylinders 14 for integration into the weight plate 12. For the convenience of maximizing the efficiency of number of cylindrical openings 15 and insertable weight cylinders 14, the weight plate 12 is provided in the drawing and the preferred embodiment with two pairs of such cylindrical openings 15 to comprise the preferred embodiment of the present invention.

Each of the weight cylinders 14 is provided to include radial aperture or groove means in the form of a diametrically and parallel extending aperture or groove 14*a* in the outer cylindrical surface thereof at a selected length position along the length dimension of the weight cylinder 14, the aperture 14*a* being positioned to extend parallel to the plane of the free-end portion 14*b* of the weight cylinder 14. In a similar manner the band member 16 is positioned to extend parallel to the plane of the end portion of the weight plate 12, and to become in alignment with the aperture 14*a* with insertion of the weight cylinder 14. In order to provide grip means for the weight cylinder 14 for rotation and/or insertion handling by the user, the free-end portion 14*b* of the weight cylinder 14 is provided with standard grip means shown in the drawings on cylinder 14, in the form of a rim formed by a shallow adjacently disposed annular groove for convenience of gripping the weight cylinder 14 but not numbered in the drawing as this feature or provision is made obvious by disclosure of the drawing alone. Other equally suitable grip means or surfaces could be provided and still provide for convenient grip rotation of the weight cylinder 14. The aperture means in the form of the aperture 14*a* is designed to present an angular radial surface groove in the cylindrical surface of the cylindrical weight 14, and the opposite end portions thereof (not numbered in the drawing but clearly shown) are provided to re-emerge with the outer cylindrical surface of the weight cylinder 14, to define a finite length for the extension of the aperture 14*a* which in turn defines or determines the degree of rotation required, in either clockwise or counter-clockwise direction as shown at the rotational arrow 21 in the drawings, in order to move the aperture 14*a* both for movement into or out of alignment with the intersecting band member 16 that is positioned within the cylindrical opening 15 through its common opening or communication with the aperture 13. The receipt of the band member 16 into the depth dimension of the groove 14*a* provides first locking means to engage the weight cylinder 14 by the band member 16 when the weight cylinder 14 is more fully inserted into the associated one of the aligned cylindrical openings 15 to restrain or lock the weight cylinder 14 against further axial movement with respect to the cylindrical opening 15 during use of the dumbbell apparatus 10.

Figure 4:
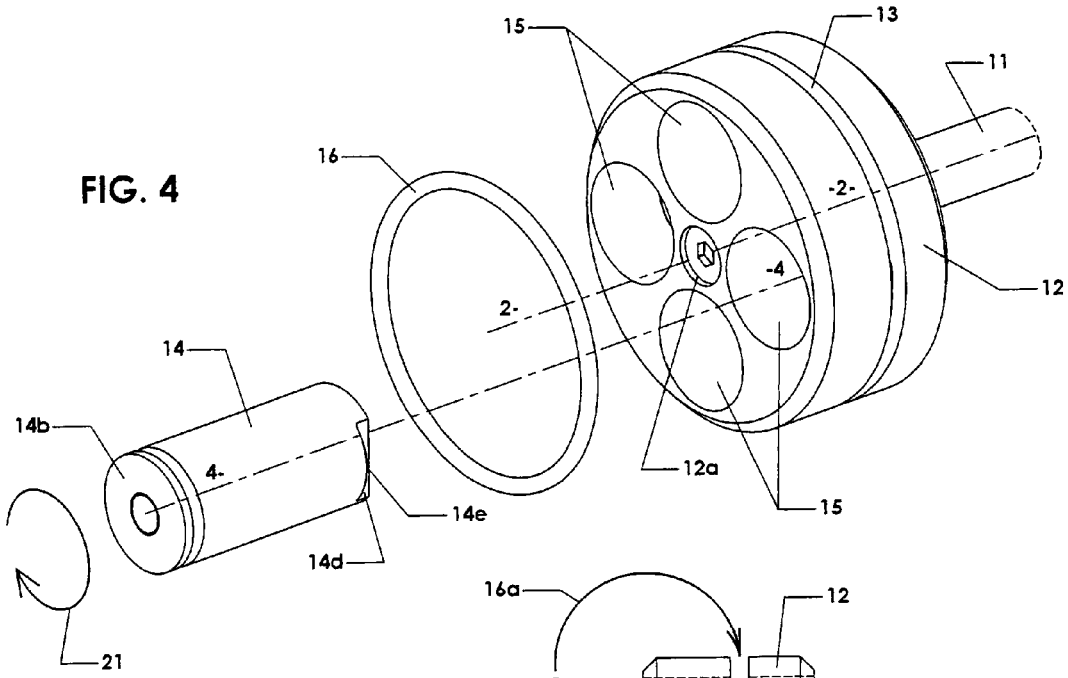
FIG. 4 is a simplified exploded isolated end view similar to the one of shown in FIG. 3.
Figure 5:
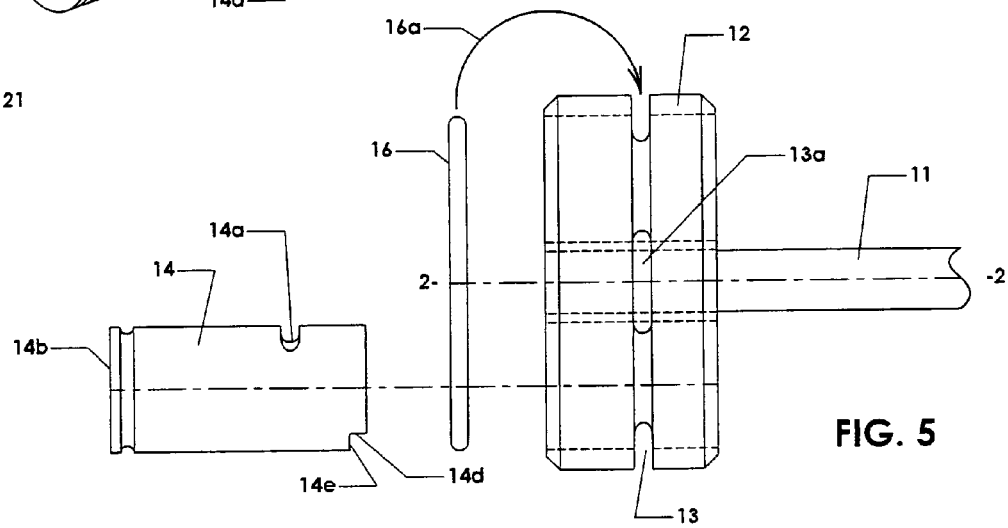
FIG. 5 is a simplified side view of the assembly of parts of FIG. 4.
Figure 6:
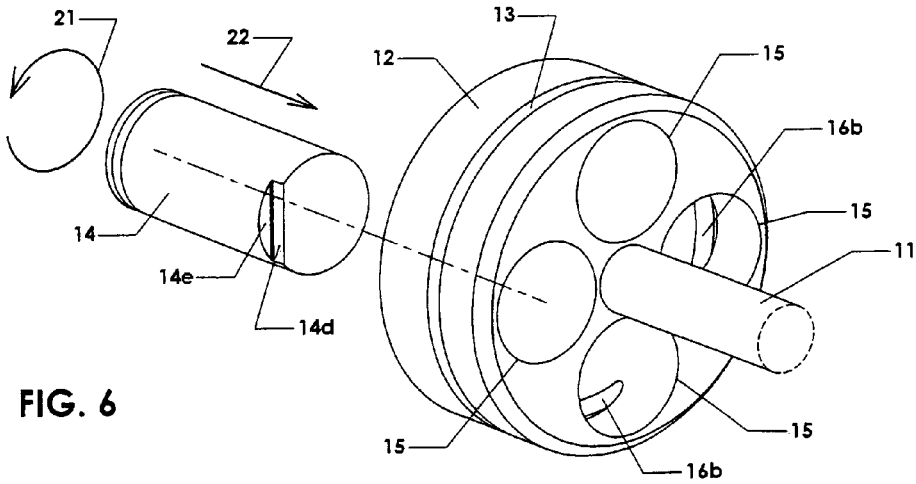
FIG. 6 is another exploded illustrated view of the assembly of parts of FIG. 4 showing the insertable weight cylinder of the current invention taken along the line 6-6 of FIG. 6.

The weight cylinder 14 is further provided with end groove means in the form of a radial end or edge groove 14*d* defining shoulder means in the form of a shoulder edge or portion 14*e*, as more clearly shown in FIG. 4 through FIG. 6 of the drawings. Upon initial insertion of the weight cylinder 14 into an aligned and associated cylindrical opening 15, the end groove 14*d* disposed on the insertable end portion thereof, is designed to engage the flexible band member 16 that intersects in the cylindrical opening 15, by engagement thereof along the length of the groove 14*d* and against the abutting support of the shoulder portion 14*e*, and thereafter, rotation of the weight cylinder 14 through the configuration of the end groove means 14*d* provides so-called first cam means to remove the intersecting band member from the associated cylindrical opening 15, by either clockwise or counter-clockwise rotation, by the rotational camming action provided by the change of the radius of the weight cylinder 14 at the location of the end groove 14*d* effected by the change of radial configuration of the end groove 14*d*, as in rotating the weight cylinder 14 for example in the direction of the arrow 21 of FIG. 4, as is more fully set forth hereinafter. The end groove 14*d* is similar to the configuration of the aperture 14*a* in presentment of an angular radial surface groove in the cylindrical surface of the cylindrical weight 14, and includes opposite end portions thereof (not numbered in the drawing but clearly shown) that are provided to re-emerge with the outer cylindrical surface of the weight cylinder 14, to define a finite length for the extension of the aperture 14*e* which in turn defines or determines the degree of rotation required, in either clockwise or counter-clockwise direction as shown at the rotational arrow 21 in the drawings, in order to move the aperture 14*e* radially to move the intersecting band member 16 back into or out of the aperture 13 in which the band member 16 is mounted. The degree of axial insertion of the weight cylinder 14 into the associated cylindrical opening 15 brings the groove 14*a* on the weight cylinder 14 into or out of axial alignment with the intersecting band member 16 that is positioned within the cylindrical opening 15 through its common opening or communication with the aperture 13, and the degree of rotation of the weight cylinder 14 within the cylindrical opening 15 brings the groove 14*a* into or out of rotational alignment with the intersecting portion of the band member 16 to allow insertion thereof or to provide removal thereof by so-called cam means. The rotation of the weight cylinder 14 upon initial insertion into an associated cylindrical opening 15 with the intersecting portion of the band member 16 being disposed to lie in the end groove 14*d* against the shoulder portion 14*e* provides first cam means to remove the band member 16 from the cylindrical opening 15 through the rotational change of the circumference of the weight cylinder as the end portions merge into the adjacent circumferential surfaces of the weight cylinder 14, and the rotation of the weight cylinder 14 upon the alignment of the band member 16 with the radial surface groove 14*a* and insertion therein, provides second cam means to remove the band member 16 from the insertion into the radial surface groove 14*a* through the rotational change of the circumference of the weight cylinder as the end portions merge into the adjacent circumferential surfaces of the weight cylinder 14. The insertion of the band member 16 into the aligned radial surface groove 14*a* provides locking means to lock the weight cylinder 14 into the cylindrical opening 15. The described action of the first cam means is designed to enable the removal of the band member 16 from the cylindrical opening 15, and to enable the insertion of the weight cylinder 14 into an associated one of the cylindrical openings 15, and the described action of the second cam means is designed to remove the band member from insertion within the radial surface groove 14*a* and to removes the locking means which the insertion comprised, the inserted band member 16 comprising first locking means and the radial surface groove 14*a* when aligned for such insertion, comprising second locking means of the locking means to lock the weight cylinder 14 within the associated cylindrical opening 15.

The central axis for insertion of the weight cylinder 14 into and removal from an aligned one of the cylindrical openings 15 is shown at line taken at 4-4 of FIG. 4 but shown throughout the drawings. In accordance with a novel feature of the current invention, the circumferential aperture 13 provided in the circumference of the weight plate 12 along its length dimension, is provided to selectively open into and intersect with portions of the cylindrical openings 15, providing an intersecting opening therebetween as shown in the drawing's first at 13*a* in FIG. 5 and in FIGS. 7 and 8, respectively, at 13*a*. When the ring-shaped flexible band member 16 is received into the circumferential aperture 13 provided in the weight plate 12, the tension of the flexible band member 16 provides that the adjacently positioned section of the band member 16 will flex or extend into and enter in intersecting manner within the cylindrical opening 15 and desirably extend angularly across an outer edge portion of the cylindrical opening 15, thereby to be designed and positioned to interfere with the otherwise free insertion of the weight cylinder 12 into and/or with respect to inserted position thereof within the associated cylindrical opening 15 of the weight plate assembly 12. This described position of the band member 16 in the aperture 13 being disposed to lie in the cylindrical opening is a first contracted position of the band member, having the first degree of tension sufficient to permit the band member 16 to be held in place in the intersecting position within the cylindrical opening 15. The removal of the band member 16 from the cylindrical opening by the first cam means to permit insertion of the weight cylinder 14 into the cylindrical opening 15 moves the band member 16 against the tension forces thereof to the second contracted position thereof to provide increased tension forces of the band member 16 to enhance return of the band member 16 to the first contracted position thereof when aligned to be inserted into the radial surface groove 14*a* thereof.

In order to remove the intersecting section of the flexible band member 16 from the openings at 13*a*, upon the insertion of the weight cylinder 14, the edge groove 14*d* is aligned to engage the intersecting section of the band member 16 at 13*a* that intersects into the cylindrical opening 15, first cam means is provided whereby rotational cam action created by designed rotation of the weight cylinder 12, the flexible intersecting section of the band member 16 is removed and forced from the interior of the cylindrical opening 15 to return into its receiving aperture 13, eliminating the interference of the intersecting section of the band member 16 and permitting the free passage of the weight cylinder 12 within the cylindrical opening 15. Thus, the interfering position of the band member 16 is removed to permit the free insertion of the aligned weight cylinder 14 within the cylindrical opening 15. To this end, and in summary, the weight cylinder 14 is provided with first cam means in the form of the edge groove 14*d* defining the shoulder portion 14*e* for the purpose of engaging the intersecting section of the flexible band member 16 as lies within the cylindrical opening 15 to be engaged by the shoulder portion 14*e*, whereby with rotation of the weight cylinder 14 in either clockwise or counter-clockwise rotation thereof, the engaged intersecting portion or interfering section of the flexible band member 16 will be moved back into its receiving circumferential aperture 13 of the weight plate 12. The movement of the band member 16 is caused by the configuration of the opposite ends portions of the edge groove 14*d* emerging with the cylindrical outer surface of the weight cylinder 14, so that with rotation of the weight cylinder 14 with respect to the receiving cylindrical opening 15, the intersecting portion of the flexible band member 16 is thus forced from the cylindrical opening 15 back into its cylindrical aperture 13 of the weight plate 12 and to engage the larger outer cylindrical surface of the weight cylinder 14 by non-alignment with the end or edge groove 14*d*. The tension of the band member 16 when removed from the end groove 14*d* is increased to provide the ready re-entry of flexible band member 16 when again aligned with the aperture 14*a* of weight assembly 12 through continued insertion of the weight cylinder 14.

The radial surface groove 14*a* of the weight cylinder 16 is similarly configured to provide opposite end portions thereof to merge with or into adjacent cylindrical outer surface of the weight cylinder 14, to comprise second cam means whereby rotational cam action created by rotation of the weight cylinder 14 removes the band member 16 from insertion into the radial surface groove 14*a* to assume the second contracted position of the band member 16, and enable axial movement of the weight cylinder 14 to allow withdrawal of the inserted weight cylinder 14 from the associated cylindrical opening 15.

In accordance with a novel feature of this invention to provide locking means to lock the weight cylinder 14 into and with respect to the receiving cylindrical opening 15, the selective rotation of the weight cylinder 14 will result in the alignment of the surface aperture 14*a* of the weight cylinder 14 with the opening 13*a* of the aperture 13 to allow or result in the re-entry of the flexible band member 16 into the cylindrical opening 15 via the aperture 13*a*, to take an angular disposed extension across the outer radial portion of the cylindrical opening 15 to be received into the aligned aperture 14*a* of the weight cylinder 14. In this described position, the weight cylinder 14 is fully or substantially fully inserted into the cylindrical opening 15, and its predetermined weight amount is thus added to the weight plate 12. With the number of weight cylinders 14 from one to four as shown in the drawings, added to the weight plate 12 by insertion into the aligned ones of the four maximum cylindrical openings 15, the novel weight plate assembly 12 of the present invention is thus configured in its preferred embodiment. It is at once obvious that more or less than four cylindrical openings 15 can be provided in a weight plate 12 depending on the relative size and diameter of the weight plate 12, the number of weight cylinders 14, and the corresponding number of cylindrical openings 15, but the preferred or optimum number thereof are as shown in the drawings, that is, four weight cylinders 14, and that number comprises the preferred embodiment of the present invention. Further, it is also a feature of the invention not shown in the drawings, but that is obvious from the enablement of the disclosure of the specification, that a second weight plate 12 could be mounted to each end portion 11*b* or 11*c* of the bar member 11, either facing in the same direction or in the opposite direction to enhance the insertion and removal of the weight cylinders 14 with respect thereto. The detailed description of any such alternate embodiment is believed to be redundant and unnecessary and the detailed description herein provided is deemed enabling to a practitioner of the pertinent art.

FIG. 5 shows a isolated side view of the weight plate assembly 12 of FIG. 4, and the arrow 16*a* illustrates the placement of the flexible band member 16 into the aperture 13 of the weight plate assembly 12 that is mounted to the bar member 11 and about the central axis of the bar member 11 and the weight plate 12 taken along the line 2-2 of FIG. 5. The flexible band member 16 will thus be mounted in the aperture 13 and will provide an intersecting section or portion 16*b* to enter into the aperture 13*a* of the aperture 13 that opens into the cylindrical openings 15, so that the intersection portion 16*b* of the band member 16 will angularly intersect the cylindrical opening 15 of each cylindrical opening 15 that is disposed in the weight plate 12. FIG. 6 discloses an intersecting portion 16*b* in each of the lower positioned cylindrical openings 15 of the weight plate 12. FIG. 6 further shows a single weight cylinder 14 in an aligned isolated perspective view to be inserted into a cylindrical opening 15 of the weight plate 12. The arrow at 21 shows the rotational capacity of the weight cylinder 14, and the direction of the arrow 21 is illustrative of a selected clockwise turning. The arrow at 22 is illustrative of the direction of insertion of the weight cylinder 14 into the aligned cylindrical opening 15. The edge groove 14*e* and the defined shoulder portion 14*d* are readily illustrated and clearly shown in FIG. 6 to be disposed on an innermost (direction of insertion) radial edge of the free-end portion of the weight cylinder 14.

Figure 7:
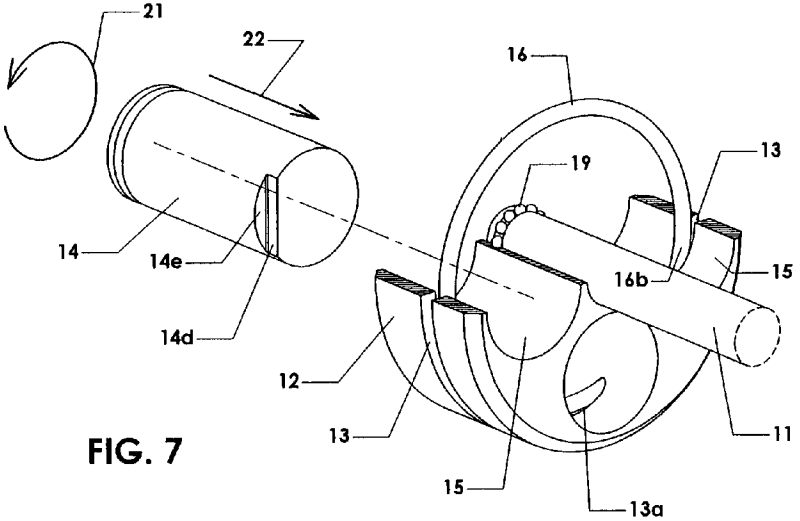
FIG. 7 is an exploded partial cutaway view of the assembly of parts of FIG. 6 and showing the insertable weight cylinder and its direction of insertion into the cut away view of the weight plate assembly similar to FIG. 6 with isolated perspective view of insertable parts thereof.
Figure 8:
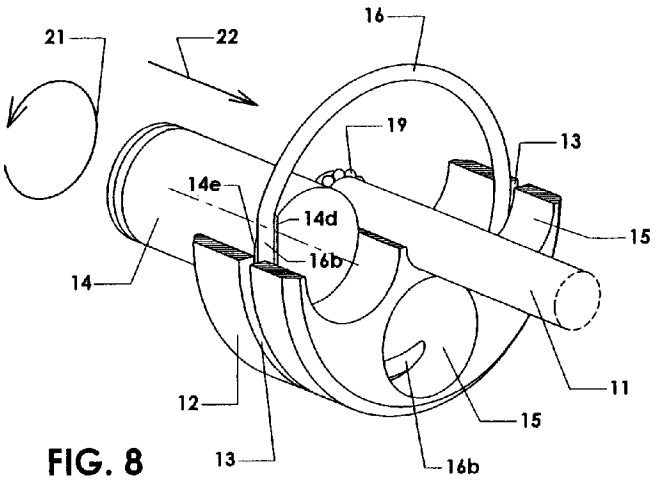
FIG. 8 is an exploded cutaway view of the assembly of parts similar to FIG. 7 with isolated perspective view of insertable parts thereof.
Figure 9:
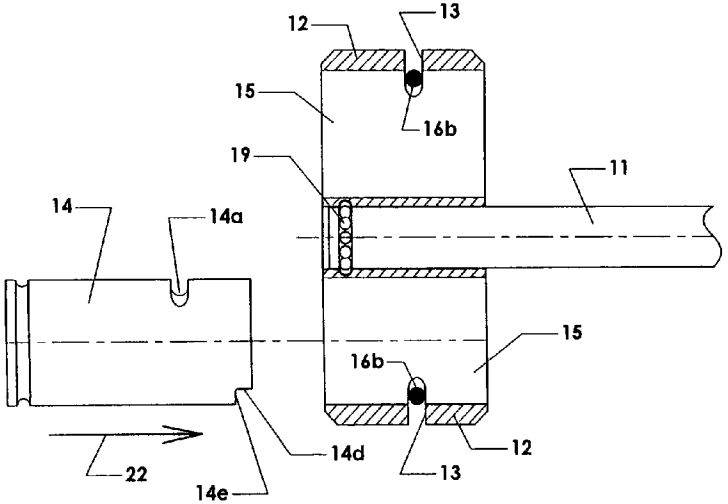
FIG. 9 is a simplified side view of the assembly of parts of FIG. 7.

FIG. 7 and FIG. 8 disclose and illustrate in greater clarity by cutaway view of the weight plate 12, the cylindrical openings 15, the flexible band member or tension ring 16 mounted in the aperture 13 of the weight plate 12, the bar member 11 on which the weight plate 12 is centrally mounted, the bearing ring set 19 and the exploded weight cylinder 14 with its rotational arrow 21 and its insertion directional arrow 22, aligned to be inserted into a selected one of the cylindrical openings 15 of the weight plate 12. In FIG. 7 the radial edge groove 14*e* and its defined shoulder portion 14*d* are clearly shown as in FIG. 6. In FIG. 8, the weight cylinder 14 has been partially inserted into the aligned cylindrical opening 15 so that the intersecting portion 16*b* of the tension ring 16 is disposed to lie in or across the edge groove 14*e*, and is thereby engaged by the shoulder portion 14*d* thereof. Once the engagement is made as herein shown in FIG. 8, the rotation of the weight cylinder 14 in the direction of the arrow 21 will displace the intersecting portion 16*b* to be removed from the interior space or cavity of the cylindrical opening 15, and permit or enable the weight cylinder 14 to be further inserted in the direction of the arrow 22 into the receiving and aligned cylindrical opening 15. FIG. 8 also shows an illustrative end portion of the bar member 11 and the bearing ring 19 enabling the rotation of the weight plate 12, and clearly shows the intersecting portions 16*b* of the flexible band member 16 to be disposed to angularly cross the associated cylindrical openings 15. FIG. 9 is an isolated end view of the parts of FIG. 7, showing a top to bottom cutaway side view of the weight plate 12 taken through a pair of upper and lower cylindrical openings 15, with the band member 16 held or positioned in the aperture 13 of the weight plate 12. The weight cylinder 14 is a side view (without cutaway) of the weight cylinder 14 showing the surface aperture 14*a* which will receive the intersecting portion 16*b* of the band member 16 when aligned lengthwise and showing the edge groove portion 14*e* and the defined shoulder portion 14*d* that will be used to align with the intersecting portion 16*b* and rotated in accordance with the action of the first cam means to remove the interfering portion 16*b* back into its holding aperture 13 to thus permit the passage of the weight cylinder 14 to be fully or substantially received as in the direction of the arrow 22 into the aligned and selected one of the cylindrical openings 15 of the weight plate 12.

Figure 10:
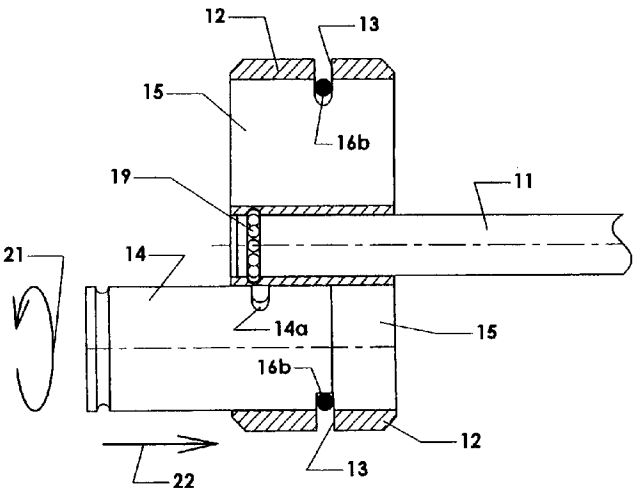
FIG. 10 is a simplified side view of the assembly of parts of FIG. 8.

FIG. 10 shows the cutaway of the weight plate 12 through a pair of the cylindrical openings 15 therein, with the cross section of the intersecting portion 16*b* of the band member 16 held in the receiving aperture 13 of the weight plate 12, and being engaged in the end groove 14*e* and situated to abut the adjacent shoulder portion 14*d*. The rotation of the weight cylinder 14 in the direction of the arrow 21 will cause the shoulder portion 14*d* and the re-emerging end portions of the end groove 14*e* with the outer surface of the weight cylinder 14 to remove by cam action of rotation, the intersecting portion 16*b* of the band member 16 from the cylindrical opening 15 and permit or enable the insertable weight cylinder 14 to pass and be received further into the cylindrical opening 15 and with rotation in the direction of the arrow 21 and insertion in the direction of the arrow 22 to have the surface aperture 14*a* to become aligned to receive the intersecting portion 16*b* of the band member 16 being housed or restrained in the aperture 13 through the communicating opening 13*a*, and the tension of the removed flexible band member 16 will cause the intersecting portion 16*b* to snap or move back into the aligned and receiving aperture 14*a* of the weight cylinder 14. This designed feature of engagement of the band member 16 with the weight cylinder 14 acts as locking means to lock, secure or hold the weight cylinder 14 in the cylindrical opening 15, with the intersecting band portion 16*b* comprising first locking means and the aperture 14*a* of the weight cylinder 14 comprising second locking means, and their engagement comprising said locking means. The edge portion 14*e* and its defined shoulder portion 14*d* comprise first cam means to remove by camming action caused by rotation of the weight cylinder 14, the intersecting band portion 16*b* from the insertion path of the weight cylinder 14 into the cylindrical opening 15. The rotation of the weight cylinder 14 will cause the alignment of the intersecting band portion 16*b* to be received within the surface aperture 14*a*, but the surface aperture is shaped or configured as a shallow recessed aperture with its end portions thereof (not numbered in the drawings but clearly shown) to re-emerge with the adjacent surface of the weight cylinder 14 so that the rotation of the weight cylinder 14 in order to remove the locking means engagement between the weight cylinder 14 and the intersecting band portion 16*b* of the band member 16, causes the intersecting band portion 16*b* to be removed by second cam means the rotational cam action caused by the rotation of the weight cylinder 14 with respect to the cylindrical opening 15.

Figure 11:
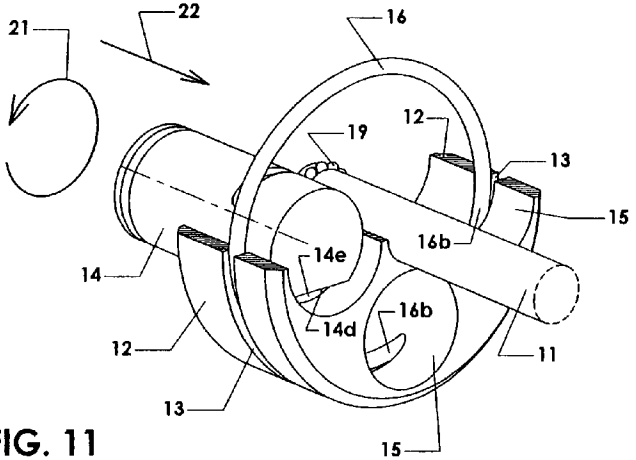
FIG. 11 is an exploded partial cutaway view of the assembly of parts of FIG. 7 with more complete insertion of the insertable parts thereof.
Figure 12:
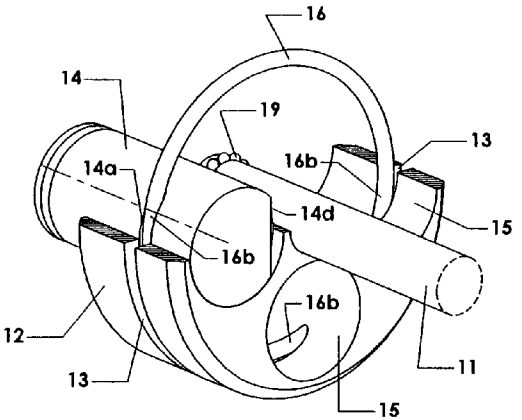
FIG. 12 is an exploded partial cutaway view of the assembly of parts of FIG. 8 with more complete insertion of insertable parts thereof.
Figure 13:
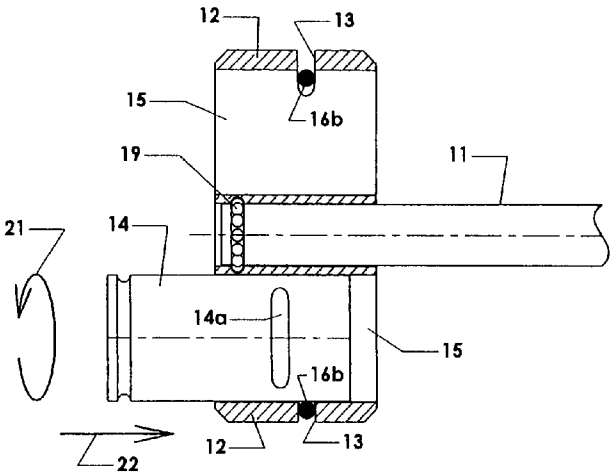
FIG. 13 is a simplified side view of the assembly of parts of FIG. 11.
Figure 14:
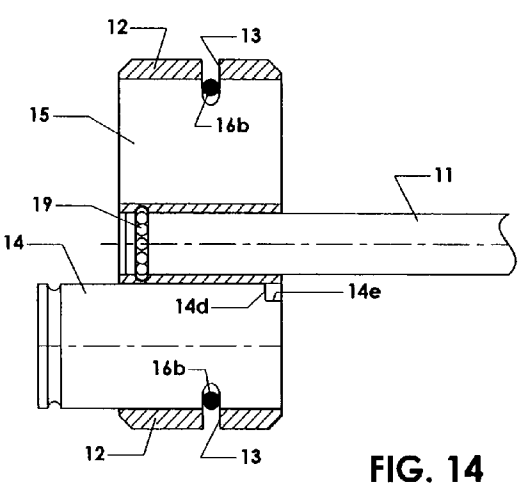
FIG. 14 is a simplified side view of the assembly of parts of FIG. 12.

FIG. 11 is similar to FIG. 7 and FIG. 12 is similar to FIG. 8 showing the progression of insertion of the weight cylinder in the direction of the arrow of FIG. 11, first in FIG. 11 of illustrate the engagement or abutment of the end groove 14*e* and defined shoulder portion 14*d* with the intersecting section 16*b* of the band member 16, and thereafter, in FIG. 8, showing the insertion of the intersecting section 16*b* of the band member 16 into the aligned aperture 14*a* of the weight cylinder 14. The combination of linear movement (arrow at 22) and rotational movement (in the direction of arrow 21) of the weight cylinder 14 within the cylindrical opening 15 of the weight plate 12, will result in the insertion of the weight bullet-pocket cylinder 14 into the associated and aligned cylindrical opening 15 of the weight cylinder 12. FIG. 11 and FIG. 12 further disclose the proper positioning of the flexible band member 16 positioned in its receiving aperture 13 of the weight plate 12, and position of the carrier bar member 11, and the providing of the ring bearing assembly 19 to permit rotation of the weight plate assembly 12. The progression of the insertable weight cylinder 14 has moved from alignment to engage the intersecting band section 16*b* as shown in FIG. 7, to engagement of the section 16*b* in the edge groove 14*e* in FIG. 8, to having been rotated to remove the intersecting band section 16*b* from the aperture 13*a* and permit the further insertion of the weight cylinder 14 into the cylindrical opening 15. FIG. 12 shows the aperture 14*a* of the weight cylinder 14 to be in alignment with the intersecting band section 16*b* and to have received the section 16*b* into the surface aperture 14*a* to lock or hold the weight cylinder 14 with respect to further linear or axial movement of the weight cylinder 14 along the cylindrical opening 15 of the weight plate 12. In this position, the weight cylinder 14 has been mounted into the cylindrical opening 15 of the weight plate 12 and is secured or locked in fixed position for use of the user in exercising with the novel bullet-pocket dumbbell exercise apparatus of the present invention. It is apparent from the detailed description in combination with the illustrations of the drawing, that the user may select the use of one or up to four weight cylinders 14 to be mounted into receiving cylindrical openings 15 provided in the weight plate assembly 12, and the loaded weight plate assembly 12 is mounted to the end portion of the bar member 11, with one or two of the weight plates 12 on each end of the dumbbell apparatus and a rotatable hand grip portion of the bar member 11 provided between the spaced apart end mounted weight plate assemblies 12. FIG. 13 is a partial cutaway side view of the parts of FIG. 11, and FIG. 14 is a partial cutaway side view of the parts of FIG. 12. Each assembly of parts of FIG. 13 and FIG. 14 have been described in connection with the explanation of FIG. 11 and FIG. 12 and are thought to be readily obvious without further detailed explanation. The parts are numbered correspondingly throughout the drawings to make the detailed description readily apparent to the reader without unnecessary duplication of explanation.

In summary, this invention discloses a novel cylindrical shaped weight plate assembly 12 that includes in combination pocket means comprising at least a pair of cylindrical pocket-like ("bullet-pocket") openings 15 to extend axially through the thickness dimension of thickened radially extending weight plate 12, the cylindrical openings 15 being radially offset or removed from the central axis 2-2 of the weight plate assembly 12 and aligned oppositely from each other across the central axis 2-2 intended to provide a balanced set of openings 15, respectively, with respect to their being axially spaced apart on opposing sides of the central axis 2-2 of the bar member 11. Each of the cylindrical openings 15 extend through the thickness dimension of the cylindrical weight plate assembly 12 disposed to extend in parallel offset position from the central axis 2-2 of the cylindrical weight plate assembly 12, and the pair thereof are equally offset from the central axis 2-2 of the weight plate assembly 12. The weight plate assembly 12 further includes insert means comprising at least a single so-called "bullet-pocket" cylindrical shaped weight cylinder 14 of corresponding or matching cylindrical dimension to the length and radius of an aligned single and associated cylindrical bullet-pocket opening 15 in the weight plate 12, and are designed and intended to be axially inserted into or removed from an aligned one or associated one of the pair of cylindrical bullet-pocket openings 15, in order to add or remove (adjust) weight amounts with respect to the weight plate assembly 12. The weight plate assembly 12 is provided with a circumferential extending radial aperture 13 encircling the central axis 2-2 of the weight plate 12 which opens into each of the bullet-pocket cylindrical openings 15, as shown at 13*a* in the drawing. First flexible locking means in the form of flexible ring-like band member 16 is positioned to be mounted and received into the radial aperture 13, and thus, is positioned to encircle the axial dimension of the weight plate 12, and where the radial aperture 13 opens into the cylindrical openings 15 at communicating aperture 13*a*, the adjacent section called the intersecting section 16*b* of the flexible band member 16 is permitted and mounted to angularly intersect and cross over in an angular crossing, the outer region of the defined opening of the cylindrical openings 15, and this is clearly shown by the angularly extending intersecting band portion 16*b*, for providing the first locking means, and the provision of the radial surface groove 14*a* positioned to receive the insertion of the band member 16*d* comprises second locking means thereby to comprise locking means that is herein set forth.

It is a novel feature of this invention to provide that the bullet-pocket weight cylinder 14 includes along its length dimension and disposed along the diametrical surface thereof, the relatively shallow grove or aperture 14*a* that lies parallel to the end portions of the weight cylinder 14, and extends along the cylindrical surface of the weight cylinder 14 only a distance that roughly matches or exceeds the extension of the intersecting section 16*b* of the flexible band member 16 into the cylindrical opening 15 via the communicating aperture 13*a* to define or comprise first locking means of the present invention. The aperture 14*a* in the diametrical surface of the weight cylinder 14 comprises the second locking means to cooperate with the first locking means in the form of the intersecting flexible band member 16*b* disposed in the cylindrical openings 15 to engage with the intersecting band member 16 by receiving the intersecting section 16*b* of the band member 16 into its opening defined by the shoulders of the aperture or groove 14*a* made into the cylindrical surface of the weight cylinder 14. The first locking means and second locking means cooperate to provide locking means to lock or secure or hold and restrain against axial movement of the bullet-pocket weight cylinder 14 within or along the bullet-pocket cylindrical openings 15 into which the weight cylinders 14 are received. The aperture 14*a* in the surface of the weight cylinder 14 is generally shaped to appear as a radially extending cutout of the cylindrical surface so that the opposite ends of the aperture 14*a* re-emerge into the surrounding cylindrical surface to provide displacement cam means for displacing by rotating cam action the received intersecting section 16*b* of the flexible band member 16 as a result of rotational movement of the weight cylinder 14 either clockwise or counter-clockwise rotation. The intersecting section 16*b* of the flexible band member 16 is moved out of or from the weight cylinder aperture 14*a* by or with the rotation of the weight cylinder 14 and the weight cylinder 14 is then free of the interfering engagement by the intersecting section 16*b* of the flexible band member 16.

It is another novel feature of the current invention to provide along the inserted free-end planar portion of the weight cylinder 14, the edge groove 14*e* (groove cut into the cylindrical edge of the free-end portion of the weight cylinder) defining an angular extending shoulder portion 14*d* cut or formed in the diametrical surface of the free-end portion of the weight cylinder 14. In the same manner as the aperture 14*a* in the weight cylinder 14 has its opposite end portions to re-emerge into the surrounding surface of the cylindrical shape of the weight cylinder 14, the opposite end portions of the angular shoulder portion 14*d* and edge groove 14*e* also re-emerge into the surrounding surface of the cylindrical surface of the weight cylinder 14. As the weight cylinder 14 is being inserted into the aligned cylindrical opening 15 in the weight plate 12, the angularly crossing intersecting section 16*b* of the flexible band member 16 is disposed to lie in an angular crossing or intersection of the cylindrical opening 15 at the point where the cylindrical opening 15 and the circumferential radially extending aperture 13 in the weight plate 12 communicate or open into each other, thereby to define the extent and shape of the communicating openings 13*a*. It is obvious that the angularly intersecting portion 16*b* of the band member 16 that is disposed to lie across the cylindrical opening 15 will interfere with the insertion of the weight cylinder 14. However, with the weight cylinder 14 rotated to an aligned position wherein the edge grove 14*e* of the weight cylinder 14 will intersect and engage the intersecting section or element 16*b* of the retractable band member 16 to lie against the defined shoulder portion 14*d*, so that with the described selected rotational movement of the weight cylinder 14, that is, the rotation of the weight cylinder 14 in either clockwise or counter-clockwise movement, will thus displace by rotational cam action the intersecting section 16*b* of the flexible band member 16 into the receiving radial aperture 13 of the weight plate 12, to allow the weight cylinder 14 to be free of the interference of the flexible band member 16 to move pass this point along the insertable length dimension of the cylindrical opening 15 for moving into fully inserted position with respect thereto. It is noted that this edge groove 14*e* is useful during insertion of the weight cylinder 14, and is immaterial during removal of the weight cylinder 14.

It can be said that the action of rotation of the weight cylinder 14 during insertion results in initially removing by cam action the interfering intersecting section 16*b* of the flexible band member 16 and permits further insertion of the weight cylinder 14 into the aligned and selected cylindrical opening 15 in the weight plate 12, and thereafter, results in achieving alignment of the radial aperture 14*a* of the weight cylinder 14 with the intersection section 16*b* of the flexible band member 16 which has been removed from the cylindrical opening 15 by cam action and is under tension to re-enter the radial surface aperture 14*a* of the weight cylinder 14 when aligned therewith. Further, in order to achieve removal of the weight cylinder 14 from its receiving cylindrical opening 15, in which it is restrained or secured or locked by joint action of the length-wise and rotational alignment between the radial aperture 14*a* on the weight cylinder 14 and the intersecting section 16*b* of the flexible band member 16, the rotational movement either clockwise or counter-clockwise of the weight cylinder 14 will result in the forced removal, by cam action caused by the configuration of the radial aperture 14*a*, of the intersecting section 16*b* of the flexible band member 16 from the radial aperture 14*a* of the weight cylinder 14, to disengage the weight cylinder 14, and permit free removal of the weight cylinder 14 from the aligned and receiving cylindrical opening 15 in the weight plate 12. The combination of the weight plate 12 and its inserted weight cylinders 14 comprise a weight plate assembly 12 in accordance with the novel features of the current invention.

The weight plate assembly 12 with its bullet-pocket weight cylinders 14 can be polished chrome or steel plated or of other suitable materials, and the bar member 11 along the mid-portion thereof can be fitted with a rotating sleeve for suitable grip of the bar member 11. All such choices of material being within the scope and intent of the present invention.

Other equally equivalent embodiments of the present invention are readily apparent, and their inclusions or provisions are thought to be unnecessary and readily available to the practitioner of the pertinent art. All such obvious and apparent embodiments are intended to be included in the detailed description made herein. Minor modifications, choices of materials, dimensions, sizes and configurations and diameters, thread sizes and the like are intended to be included herein, and are choices to be readily made by the practitioner of the pertinent art without deviation from the scope and intent and teachings of the present invention.

What is claimed is:

1. An improved bullet-pocket dumbbell apparatus including in combination, an elongated bar member providing oppositely disposed free-end portions and a central grip portion for manual lifting, at least a pair of bullet-pocket cylindrical shaped weight plates rotatable and attachable to the free-end portions of the bar member in axial alignment with the axial dimension of the bar member, each weight plate including at least a pair of cylindrical openings extending in through the length dimension of the weight plate in parallel alignment to each other and spaced parallel balanced alignment with the axial dimension of the weight plate, a peripheral aperture extending circumferentially on the weight plate intermediately along its axial length and opening into each of the cylindrical openings in the weight plates, flexible band means including an annular shaped flexible band member insertedly received into the peripheral aperture and correspondingly received into the cylindrical openings of the weight plates, respectively, at least a pair of bullet-shaped cylindrical insert weights insertable into the pair of cylindrical openings of the weight plates, respectively, each of the insert weights having a predetermined weighted mass, and including along an interior free-end portion when inserted in the cylindrical openings, first groove means provided in a selected annular direction across the interior circumferential edge of the free-end portion of the insert weight to define a partially extending radial groove having a shoulder portion and opposite end portions terminating into the adjacent cylindrical surface of the insert weight, the inserted flexible band member being extended within the cylindrical opening and being engaged by the insert weight when inserted into the cylindrical opening, the insert weight being selectively rotated to insert the flexible band member into the first groove means to be engaged by the shoulder portion thereof and with selective rotation of the insert weight, the flexible band member is removed by the camming action of a selected end portion of the first groove means to move the flexible band member from a first contracted position to an increased tension second contracted position when removed from the cylindrical opening, and second groove means provided in a selected annular direction across the medial length dimension of the insert weight to define a partially extending medial radial groove having predetermined depth dimension and a pair of opposite end portions terminating into the adjacent cylindrical surface of the insert weight, the rotatable insert weight being further selectively rotated in the cylindrical opening to align the flexible band member which is in the second contracted position thereof, with the aligned medial radial groove on the insert weight, to thereby receive the flexible band member therein when allowed to be restored to the first contracted position thereof, whereby aligning the flexible band member comprises locking means to secure the insert weight within the cylindrical opening of the weight plate, respectively.

2. An improved bullet-pocket dumbbell apparatus as claimed in claim 1 wherein the direction of annular extension of the medial radial groove of the second groove means extends in parallel alignment with the direction of annular positioning of the flexible band member with the insert weight being insertedly received in the selected cylindrical opening of the weight plate, and further insertion and rotational movement of the weight plate provides overlapping alignment of the medial radial groove with the flexible band member to enable the flexible band member to return to its first contracted tension position to extend with and along the medial radial groove of the weight plate, thereby to utilize the flexible band member to engage and secure the associated weight plate within the selected cylindrical opening.

* * * * *